United States Patent [19]

Sobotka

[11] 4,269,337

[45] May 26, 1981

[54] ROLLER SKATE CARRIER

[76] Inventor: Frank Sobotka, 974 Hadley Dr., Sharon, Pa. 16146

[21] Appl. No.: 160,321

[22] Filed: Jun. 17, 1980

[51] Int. Cl.[3] ..... B65D 71/00

[52] U.S. Cl. ..... 294/163; 12/120.5; 211/37; 224/45 S; 224/45 P; 224/917

[58] Field of Search ..... 224/45 P, 45 Q, 45 S, 224/45 R, 50, 225, 232, 234, 917; 12/120.5; 211/34, 37

[56] References Cited

U.S. PATENT DOCUMENTS

| | | | |
|---|---|---|---|
| 2,587,971 | 3/1952 | Crawford | 12/120.5 X |
| 3,248,027 | 4/1966 | Pfleider | 224/45 S |
| 3,272,413 | 9/1966 | Pfleider | 224/45 S |
| 3,497,891 | 3/1970 | Vöster et al. | 224/45 S |
| 3,718,242 | 2/1973 | Larson | 224/45 Q X |

*Primary Examiner*—Steven M. Pollard

*Attorney, Agent, or Firm*—Victor J. Evans & Co.

[57] ABSTRACT

A carrier for roller skates including a frame having sides provided with vertically spaced recesses for accommodating the wheel and axle assemblies of a pair of roller skates to support the roller skates in oppositely disposed relationship on the frame together with a releasable locking device on the frame engageable with at least one of the wheel and axle assemblies on each of the skates to retain the wheel and axle assemblies and therefore the skates within the recesses on the frame.

10 Claims, 6 Drawing Figures

ROLLER SKATE CARRIER

BACKGROUND OF THE INVENTION

Various types of sporting equipment such as skis, roller skates and the like which are carried by an individual to a point of use present certain difficulties from the standpoint of convenience and comfort during such transport. Such sporting equipment particularly when utilized in pairs such as roller skates, are awkward to carry so that they are frequently dropped with resulting damage and personal injury. Furthermore, roller skates and the like present the additional problem of storage for ready accessibility at the point of use becoming easily separated or confused with skates belonging to others thereby detracting somewhat from the enjoyment of the sport.

OBJECTS AND SUMMARY OF THE INVENTION

Accordingly a primary object of this invention is to provide a new and novel carrier for a pair of roller skates.

Another object of this invention is to provide a new and novel carrier for roller skates which permit a pair of roller skates to be carried in a compact convenient manner by an individual.

A further object of this invention is to provide a new and novel carrier for roller skates which is simple and inexpensive in construction and which maintains the skates together in an assembled relationship for ready storage and accessibility.

Still another object of this invention is to provide a new and novel carrier for roller skates which is of rugged construction, which positively maintains a pair of roller skates in a compactly arranged condition for ready portability and which positively retains the skates on the carrier in such a manner that risk of dislodgement is prevented while permitting easy mounting and dismounting of the skates from the carrier.

The objects of the invention and other related objects are accomplished the provision of a carrier for a pair of roller skates of the type including a boot and a pair of wheel and axle assemblies mounted in spaced relationship on the sole of the boots which includes a frame having recesses in each of the sides of the frame arranged in a vertically spaced relationship corresponding to the spacing of the wheel and axle assemblies on the boots. The recesses are adapted to supportingly engage the wheel and axle assemblies on a respective one of the boots to support the skates in oppositely disposed relationship on the side of the frames and releasable locking means are provided on the frame which are engageable with one of the wheel and axle assemblies on each of the boots to retain the wheel and axle assemblies in the recesses.

The above-mentioned and other features and objects of the present invention will become more apparent by reference to the following description taken in conjunction with the accompanying drawing wherein like reference numerals denote like elements.

DESCRIPTION OF THE PREFERRED EMBODIMENTS

Figure 1:
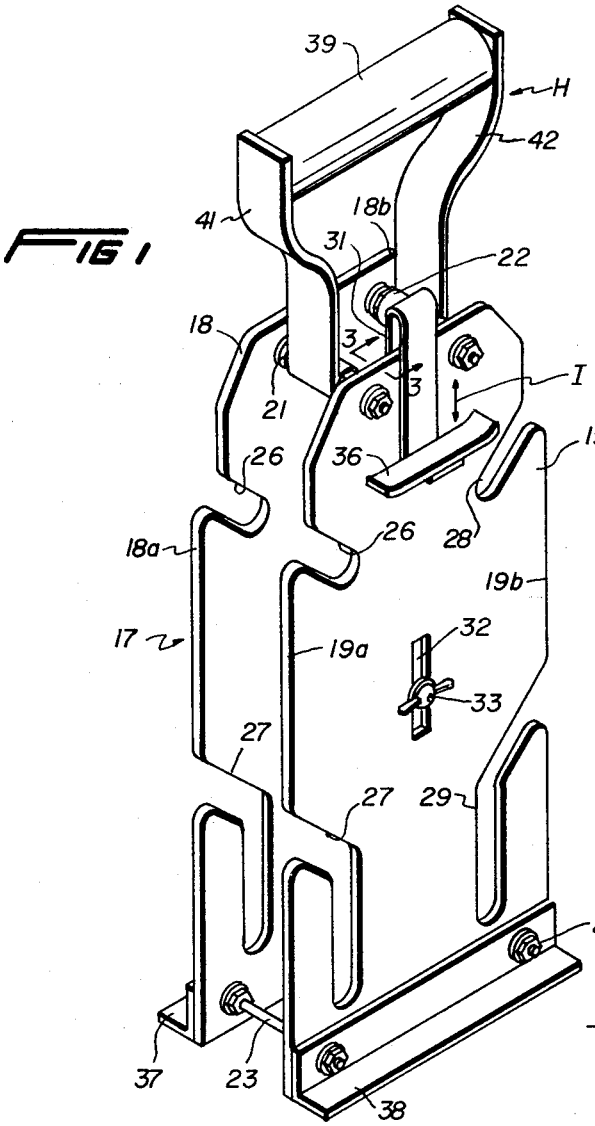
FIG. 1 is a perspective view of one embodiment of the roller skate carrier of the invention.
Figure 2:
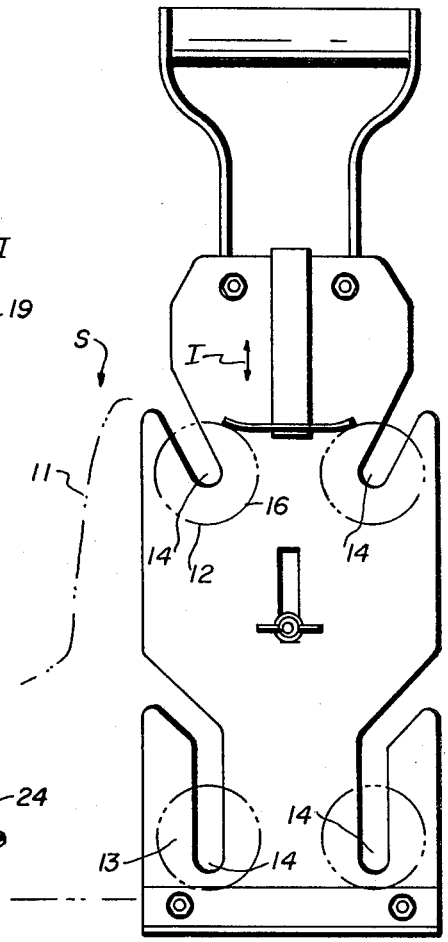
FIG. 2 is a side elevation view of the carrier of FIG. 1.

Referring now to the drawings and to FIG. 1 in particular, there is shown one embodiment of a carrier constructed in accordance with the invention and designated generally by the letter C. The carrier C is arranged to support a pair of skates one of which is shown partially in broken lines in FIG. 2 and designated generally by the letter S. As is well known, the skates S are of conventional construction and include a boot 11 on the sole of which is suitably secured a pair of wheel and axle assemblies 12, 13 arranged in vertically spaced relationship. Each of the wheel and axle assemblies 12, 13 include an axle 14 on the opposite ends of which are mounted freely rotatable wheels 16 as shown in FIG. 2.

Referring now again to FIG. 1, the carrier C comprises a frame designated generally by the reference numeral 17 which comprises a pair of substantially identical plate members 18, 19 and means are provided for fixedly securing the plate members 18, 19 together in transversely aligned, spaced-apart relationship. In the embodiment of FIG. 1, the plate members 18, 19 are secured together at the top by means of bolts 21, 22 and at the bottom by means of bolts 23, 24.

Recess means are provided in each of the sides of the frame 17 which are arranged in vertically spaced relationship corresponding to the spacing of the wheel and axle assemblies 12, 13 which are adapted to engage the wheel and axle assemblies on a respective one of the boots 11 to support the skates S in oppositely disposed relationship on the side of the frame 17. More specifically, in the embodiment of FIG. 1, the recess means comprise a pair of vertically spaced slots 26, 27 and 28, 29 in each of the side edges 18*a*, 19*a* and 18*b*, 19*b* of the plate members 18, 19 respectively. The slots 26, 27 and 28, 29 in the plate members 18, 19 are arranged in transversely aligned relationship and are directed inwardly and downwardly within the plate members 18, 19 for accommodating the axles 14 of the wheel and axle assemblies 12, 13 as the skates S are moved downwardly with the axles 14 in engagement with the bottoms of the slots.

Figure 3:
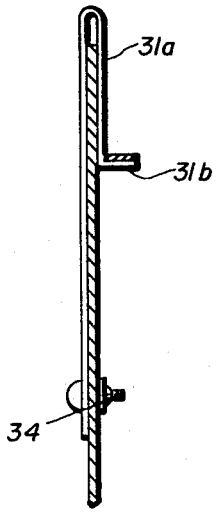
FIG. 3 is a sectional view taken substantially along line 3—3 of FIG. 1 in the direction of the arrows.

The carrier C includes releasable locking means on the frame 17 engageable with one of the wheel and axle assemblies on each of the boots 11. More specifically, in the embodiment of FIGS. 1–3, the locking means comprise a vertically extending bar 31 extending vertically along the inner surface of the plate member 19 and provided with a U-shaped upper portion 31*a* extending over the upper edge of the plate member 19 and downwardly adjacent the outer surface of the plate member 19 as shown best in FIG. 3. The plate member 19 is provided with a vertically extending slot 32 for accommodating a wing nut 33 engageable with a suitably threaded aperture 34 in the bar 31 for releasably retaining the bar 31 in an adjusted vertical position. The upper end portion 31*a* of the bar 31 is provided with a flange 31*b* to which is secured by welding or the like a laterally extending arm 36 as shown best in FIG. 1.

Thus, the bar 31 may be moved vertically, when the wing nut 33 is released, upwardly into a release position to permit the skates S to be mounted on the carrier C. After the skates S have been mounted on the carrier C, the bar 31 is moved downwardly as indicated by the double arrow I until the arm 36 is positioned in overlying and abutting engagement with the wheels 16 on the upper wheel and axle assemblies 12 of both of the skates S to retain the axles 14 within the slots 26–29 and the skates S are positively retained on the frame 17.

Preferably, a foot, such as a pair of angle irons 37, 38 are suitably mounted on the bottom of the frame members 18, 19 respectively for engagement with a supporting surface to support the carrier C in an upright position as shown in FIG. 1. In the illustrated embodiment, the angle irons 37, 38 are suitably secured to the frame members 18, 19 respectively by means of the bolts 23, 24.

The skate carrier C of the invention also preferably includes a carrying handle on the top of the frame 17 designated generally in FIGS. 1, 2 by the letter H. The handle H preferably includes a handgrip 39 secured by means of straps 41, 42 to the bolts 21, 22 respectively as shown.

Figure 4:
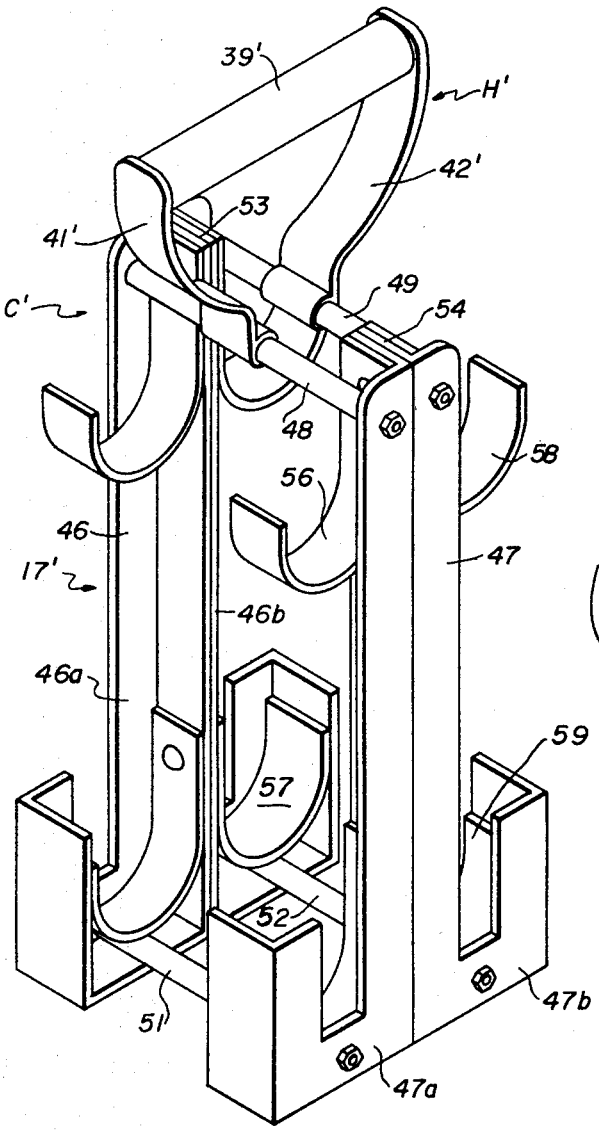
FIG. 4 is a perspective view of another embodiment of the roller skate carrier of the invention.
Figure 5:
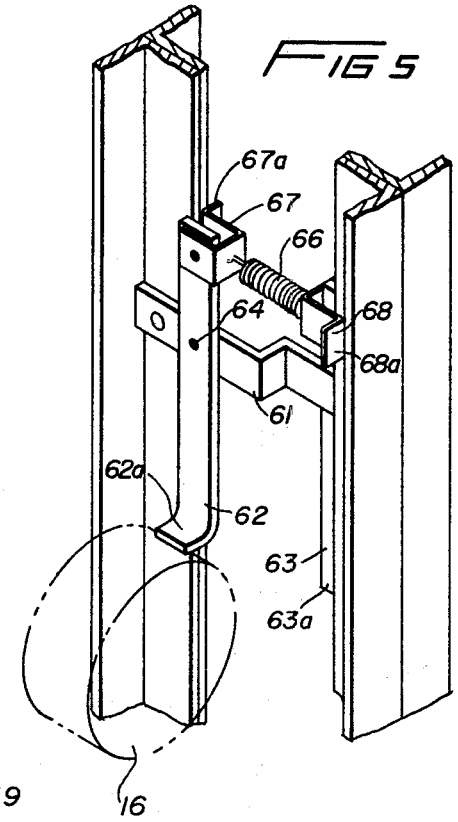
FIG. 5 is a fragmentary perspective view of a portion of the carrier of FIG. 4.
Figure 6:
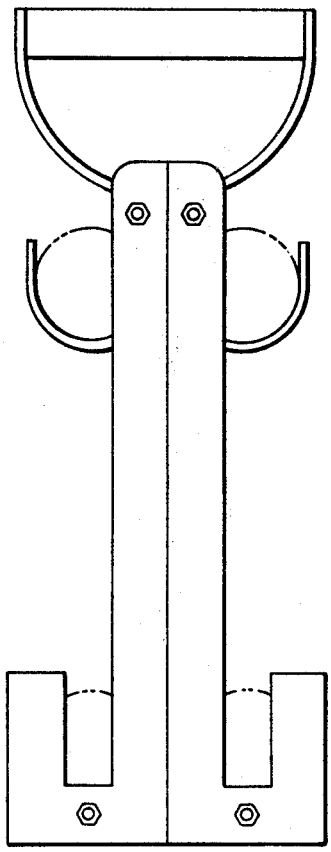
FIG. 6 is a side elevation view of the carrier of FIG. 4.

Referring now to FIGS. 4–6 there is shown another embodiment of the skate carrier of the invention designated generally by the letter C′ and wherein like numerals are utilized to identify like parts. In the embodiment of FIG. 4, the frame 17′ includes a pair of substantially identical elongated, brackets 46, 47, preferably T-shaped in cross section, and fixedly secured together in transversely aligned, spaced-apart relationship by means of bolts 48, 49 and 51, 52. Each of the brackets 46, 47 is preferably formed from a pair of L-shaped members **46*a*, 46*b* and 47*a*, 47*b* which are suitably secured together to form inwardly directed vertically extending webs 53, 54 respectively. Thus, the lower portions of each of the L-shaped members 46*a*, 46*b* and 47*a*, 47*b* form a foot for supporting the frame 17′** on a supporting surface in an upright position.

The carrier C′ of FIG. 4 is also provided with recess means comprising a pair of vertically spaced hook members 56, 57 and 58, 59 extending laterally outward from each side of the brackets 46, 47 with the pairs of hook members 56, 57 and 58, 59 on each of the brackets 46, 47 respectively arranged in transversely aligned relationship for accommodating the wheels 16 of the wheel and axle assemblies 12, 13 on the skates S as shown best in FIG. 6.

Releasable locking means are provided on the carrier C′ for retaining the skates S in the supported position on the frame 17′ which, as shown best in FIG. 5, include a transversely extending link 61 secured at opposite ends to the webs 53, 54 on each of the brackets 46, 47 respectively. A pair of locking levers 62, 63 are pivotally mounted at 64 on the link 61 adjacent each of the brackets 46, 47 and each of the locking levers 62, 63 is provided with a laterally directed lower end portion **62*a*, 63*a* respectively for engagement with at least one of the wheels 16 on each of the boots 11 to retain the wheels 16 within the associated hook member 56–59. The locking means of FIG. 5 also includes yieldable biasing means connected to the locking levers 62, 63 for moving the locking levers into overlying abutting engagement with the wheels 16 as shown best in FIG. 5. In the illustrated embodiment, a spring 66 is connected at opposite ends to the upper ends of each of the locking levers 62, 63 by means of a tabs 67, 68 respectively so as to yieldingly urge the locking levers pivotally into the locking position of FIG. 5. Each of the tabs 67, 68 is provided with an end portion 67*a*, and 68*a* respectively engageable by the hands of a user for pivoting the locking levers 62, 63 out of the locking position of FIG. 5 into the release position as shown in broken lines in FIG. 5**.

In the embodiment of FIGS. 4–6 the carrier C′ is also provided with a carrying handle H′ comprising a handgrip 39′ connected by means of straps 41′, 42′ to the bolts 48, 49 at the upper end of the frame 17′.

Having thus described the preferred embodiment of the invention it should be understood that numerous structural modifications and adaptations may be resorted to without departing from the spirit of the invention.

What is claimed is:

1. A carrier for a pair of roller skates of the type including a boot and a pair of wheel and axle assemblies mounted in spaced relationship on the sole of said boot comprising, in combination, a frame, said frame being provided with recess means on each side arranged in vertically spaced relationship corresponding to the spacing of said wheel and axle assemblies, said recess means on each frame side being adapted to supportingly engage the wheel and axle assembly on a respective one of said boots to support said skates in oppositely disposed relationship on the sides of said frame and releasable locking means on said frame engageable with one of said wheel and axle assemblies on each of said boots for retaining said wheel and axle assemblies in said recess means.

2. A carrier in accordance with claim 1 including a carrying handle on the top of said frame.

3. A carrier in accordance with claim 2 including a foot on the bottom of said frame for supporting said frame in an upright position on a supporting surface.

4. A carrier in accordance with claim 1 wherein said recess means comprise a plurality of inwardly and downwardly directed slots in each of said frame sides for slidably accommodating the axles of said wheel and axle assemblies of a respective one of said boots.

5. A carrier in accordance with claim 4 wherein said frame comprises a pair of substantially identical plate members, means for fixedly securing said plate members together in transversely aligned, spaced-apart relationship and wherein said plurality of slots include a pair of vertically spaced slots in each side edge of said plate members with said pairs of slots in the corresponding side edges of said plate members arranged in transversely aligned relationship for accommodating the axles of said wheel and axle assemblies.

6. A carrier in accordance with claim 5 wherein said locking means is arranged for overlying abutting engagement with at least one of the wheels on each of said boots to retain said axles in the bottom of said slots.

7. A carrier in accordance with claim 6 wherein said locking means comprise a bar slidably disposed on one of said plate members, a laterally extending arm mounted on said bar for overlying abutting engagement with the corresponding wheels of one of the adjacent wheel and axle assemblies on each of said boots in an adjusted position of said bar and means for clamping said bar in said adjusted position.

8. A carrier in accordance with claim 1 wherein said frame comprises a pair of substantially identical elongated brackets, means for fixedly securing said brackets together in transversely aligned, spaced-apart relationship and wherein said recess means comprise a pair of vertically spaced hook members extending laterally outward from each side of said brackets with said pairs of hook members in the corresponding sides of said brackets arranged in transversely aligned relationship for accommodating the wheels of said wheel and axle assemblies.

9. A carrier in accordance with claim 8 wherein said locking means is arranged for overlying abutting engagement with at least one of the wheels on each of said boots to retain said wheels within said hook members.

10. A carrier in accordance with claim 9 wherein said locking means comprise a transversely extending link connected at opposite ends to said brackets, a pair of vertically extending locking levers pivotally mounted on said link adjacent a respective one of said brackets, yieldable biasing means connected to said locking for pivotally moving said locking levers from a release position into a locking position with one end of said locking levers in overlying abutting engagement with at least one of said wheels on each of said boots to retain said wheels within said hook members.

* * * * *